United States Patent [19]

Brennan

[11] Patent Number: 5,043,060

[45] Date of Patent: Aug. 27, 1991

[54] SWIMMING POOL SKIMMER

[76] Inventor: Joseph Brennan, 6953 Coleshill Dr., San Diego, Calif. 92119

[21] Appl. No.: 594,115

[22] Filed: Oct. 9, 1990

[51] Int. Cl.[5] ..... E04H 4/16

[52] U.S. Cl. ..... 210/122; 210/169; 210/242.1; 210/470; 15/1.7; 43/9.1; 4/496

[58] Field of Search ..... 210/122, 237, 238, 169, 210/242.1, 359, 470; 15/1.7; 43/9.1, 11; 4/490, 494, 496

[56] References Cited

U.S. PATENT DOCUMENTS

| | | | |
|---|---|---|---|
| 3,863,237 | 1/1975 | Doerr | 210/169 |
| 4,053,412 | 10/1977 | Stix | 210/169 |
| 4,518,495 | 5/1985 | Harding | 210/242.1 |
| 4,822,487 | 4/1989 | Loich | 210/470 |
| 4,889,622 | 12/1989 | Newcombe-Bond | 210/169 |
| 4,994,178 | 2/1991 | Brooks | 210/169 |

*Primary Examiner*—Stanley S. Silverman

*Assistant Examiner*—Christopher Upton

*Attorney, Agent, or Firm*—Charles C. Logan, II

[57] ABSTRACT

A portable swimming pool skimmer that may be dragged around the perimeter of a swimming pool by a person gripping its tether line. The swimming pool skimmer has a pair of laterally spaced end walls that are secured to the respective opposite ends of three tubular connecting members. The first two of these tubular members are air tight so that they have a tendency to float to the top of the water surface. The third tubular member has a plurality of apertures therein that allows it to fill with water and causes it to sink beneath the surface of the water. A net is connected between the two air tight tubular connecting members and it has a sufficient amount of slack so that it forms a concave shape when the skimmer is dragged around the pool for collecting the undesirable objects floating on the water surface.

7 Claims, 1 Drawing Sheet

SWIMMING POOL SKIMMER

BACKGROUND OF THE INVENTION

The invention relates to swimming pools and more specifically to a portable skimmer that can be pulled around the perimeter of the swimming pool.

The present method of cleaning debris from the water surface of a swimming pool is done by one of two methods. One involves running the swimming pool pump that draws the water in through the skimmer located adjacent one side of the swimming pool. To do this may require several hours of running the pump.

A quicker method of cleaning the debris off the surface of the swimming pool is to manually dip a hand skimmer into the water picking up the debris and remove it. This may be done with the hand skimmer held in a person's hand while standing on the edge of the pool or the hand skimmer can be attached to the end of a telescopic pole. This method requires physical energy and it is slow and tedious to get the top surface of the pool clean.

It is an object of the invention to provide a novel portable swimming pool skimmer that can be dragged along the top surface of the swimming pool and which merely requires the person to walk around the perimeter of the pool while dragging it.

It is also an object of the invention to provide a novel portable swimming pool skimmer that is economical to manufacture and market.

It is another object of the invention to provide a novel portable swimming pool skimmer that requires minimal instruction on how to use it and which can be used by adults and children alike.

It is an additional object of the invention to provide a novel portable swimming pool skimmer that dramatically reduces the amount of time required to remove debris from the top surface of a swimming pool.

SUMMARY OF THE INVENTION

Applicant's novel portable swimming pool skimmer has been designed so children and adults alike can use it. It has been designed to reduce the amount of manual time required to clean the debris from the top surface of the swimming pool.

The portable swimming pool skimmer has two laterally spaced end walls that normally would be spaced anywhere between 1½ foot to 8 feet apart. In most applications the user would probably desire the width of the unit to be in the 3 to 5 foot range. In the preferred embodiment, these end walls have a triangular configuration. Three elongated tubular connecting members have their opposite ends secured to the inside surface of the end walls generally at the respective corners of the triangularly shaped end walls. Two of these tubular connecting end members are filled with air and their ends are sealed so that they have a tendency to float the swimming pool skimmer with these two connecting members on the top surface of the water. The third connecting member has a plurality of apertures in it that allow it to fill with water and cause it to sink beneath the surface of the water when the pool skimmer is placed onto the surface of the water of the swimming pool.

A net extends substantially the entire width between the laterally spaced end walls and it has its top end connected to one of the tubular air tight connecting members and its other end connected to the other tubular air tight connecting member. The height of the net would generally be at least 2 times the distance of the vertical spacing of the two air tight tubular connecting members so that the net is given a concave inner configuration when it is dragged through the water for picking up the debris on the top surface of the water. A tubular anchoring post extends inwardly from the respective end walls and they receive respectively the opposite ends of a predetermined length of tethering line. Generally the tethering line is secured therein by tying knots in its oppsite ends after it has been threaded through the respective anchoring posts and these ends are prevented from being pulled outwardly therefrom by a restricted diameter aperture within the anchoring post. If the tethering line is made of a plastic material such as nylon, often the ends are seared by a flame to prevent unraveling of the line. The tubular tether anchoring posts also keep the tether line away from the swimming pool coping preventing line wear, when the skimmer is being used.

A flange extends outwardly from the respective end walls adjacent their front edges and a plurality of brush assemblies have their rear ends captured therein. This line of brush assemblies provde a resilient surface that may travel along the tile surface of the swimming pool and prevent the end walls from scratching or catching on surfaces along the edges of the pool. The brush assembblies also provide a wiping action for removing debris which has accumulated along the tile surface.

Initially when using the skimmer, it is placed in the swimming pool in an upright position that allows water to enter the apertures in the third connecting member causing it to sink with the mouth of the net facing upward. Once all of the air bubbles escaping from the third connecting member has stopped, the person using the skimmer would grasp the tether line toward the end of its loop and pull it slowly around the pool. As the skimmer is pulled in either direction it rotates so that the mouth of the net is parallel with the water so as to accept floating debris. While doing this the skimmer should be substantially perpendicular to the pool coping at all times. While this is occuring, the debris floating on the top surface is naturally led into the interior of the net and captured therein. As soon as the tether line is allowed to go slack, the skimmer automatically rotates to its original position keeping the debris inside the net. When it is desirable to empty the skimmer, one merely removes it from the water, turns it upside down and hoses the debris therefrom. The skimmer can be pulled in either direction simply by stopping at anytime which will allow the skimmer to atutomatically right itself and then the person can start pulling in the opposite direction.

DESCRIPTION OF THE PREFERRED EMBODIMENT

Figure 1:
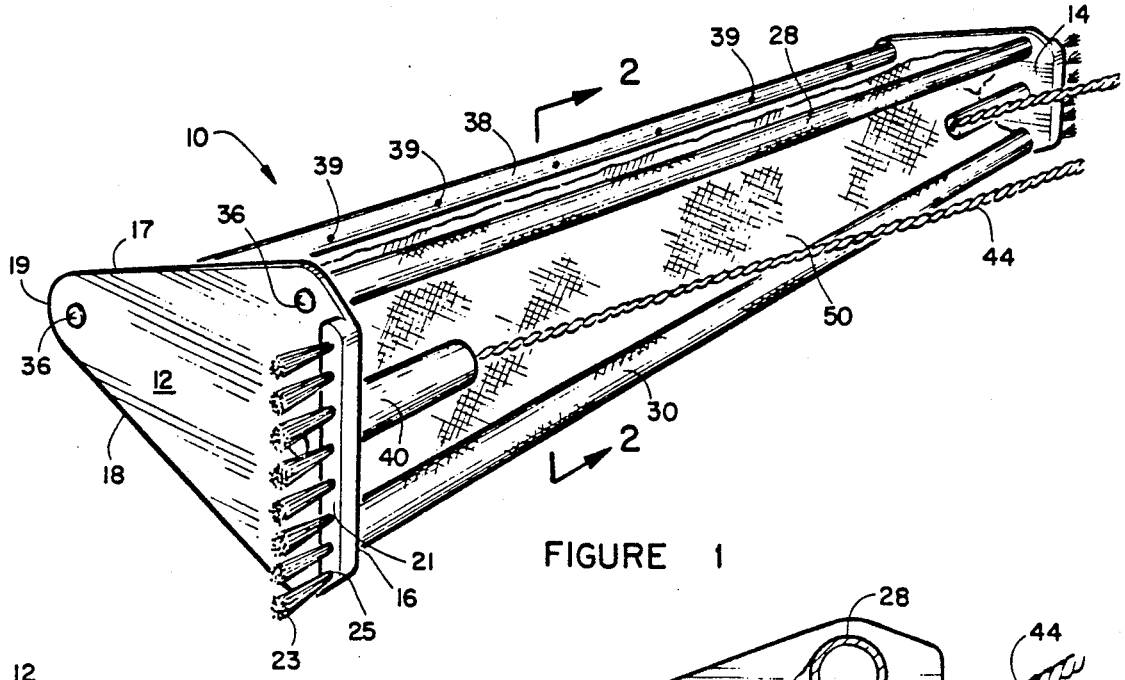
FIG. 1 is a front perspective view of applicant's novel portable swimming pool skimmer.

Applicant's novel portable swimming pool skimmer will now be described by referring to FIGS. 1–4 of the drawing. The swimming pool skimmer is generally designated numeral 10.

Swimming pool skimmer 10 has a pair of laterally spaced end walls 12 and 14. They each have a front edge 16, a top edge 17, a bottom edge 18, and a rear edge 19. A flange 21 extends perpendicular to front edge 16 and it has a plurality of brush assemblies 23 that are secured in apertures 25.

Figure 4:
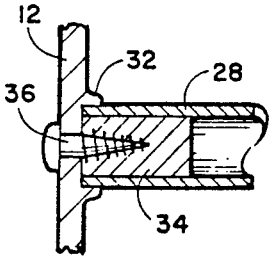
FIG. 4 is a partial cross sectional view illustrating the manner in which the first and second tubular connecting members are secured to the end walls.
Figure 2:
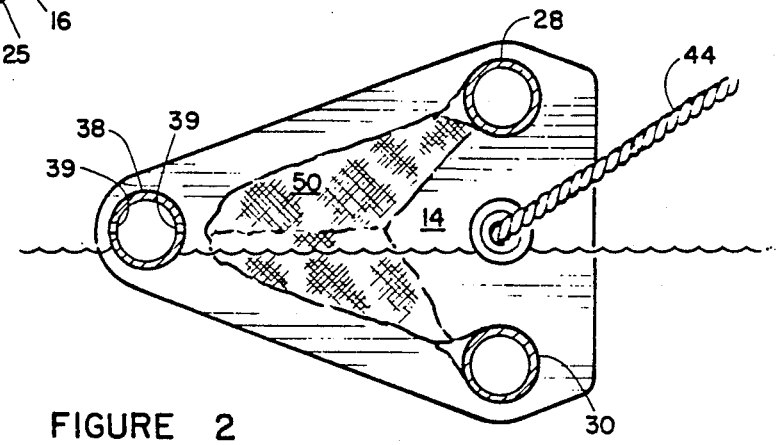
FIG. 2 is a cross sectional view taken along lines 2—2 of FIG. 1.
Figure 3:
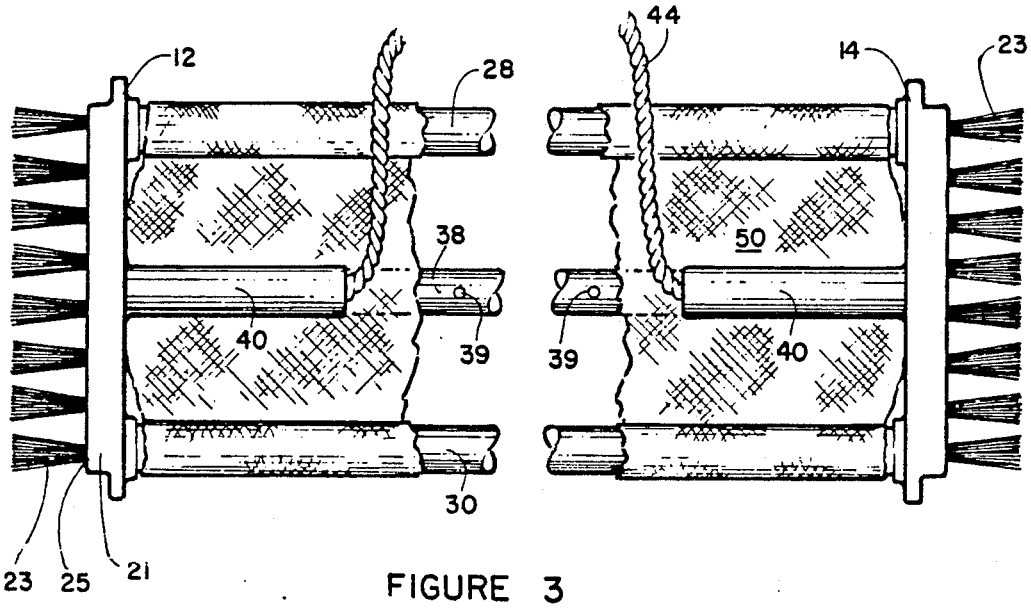
FIG. 3 is a front elevation view of the portable swimming pool skimmer.

First and second tubular connectig members 28 and 30 have their opposite ends connected to the inner surfaces of end walls and 14. The exact manner of their attachment is illustrated in FIG. 4. Cylindrical collars 32 extend outwardly from the inner surface of the end walls and they receive the respective opposite ends of the tubular connecting members. A plug 34 is inserted into each of the ends of the tubular connecting members to make them air tight and bouyant and screws 36 secure them to their respective end walls. Tubular connecting member 38 has its opposite ends secured to the end walls in the same manner but it has a plurality of apertures 39 along its length that allow water to seep into it.

Tubular anchoring posts 40 have their one end molded to the inner surface of end walls 12 and 14. The opposite ends of a tether line 44 are threaded through the anchoring posts and knoted or heat welded to prevent the ends from pulling out from the anchoring post. Tether line 44 forms a closed loop that is grasped by the user to pull the portable swimming pool skimmer around the periphery of the pool. The skimmer can also be used to clean the center of a pool by grasping the tether line closer to one of the end plates, the skimmer will act like a rudder and go to the center of the pool. Net 50 extends substantially the entire width between the laterally spaced end walls 12 and 14. It has its top edge secured to tubular connecting member 28 and its bottom end secured to tubular connecting member 30. The height of the net is generally at least twice the vertical distance between connecting members 28 and 30. This allows the net to form a concave configuration into which the debris floating on the surface of the swimming pool water is drawn into. The respective lateral edges of the net are sewn together to close these ends.

What is claimed is:

1. A portable swimming pool skimmer comprising:

a pair of upright oriented end walls that are laterally spaced from each other a predetermined distance, said end walls having a front edge, a rear edge, a top edge and a bottom edge;

a first elongated connecting member having a left end and a right end, said respective ends being secured to said respective end walls adjacent the front ends of their top edges;

a second elongated connecting member having a left end and a right end, said respective ends being secured to said respective end walls adjacent the front ends of their bottom edges;

a third elongated connecting member having a left end and a right end, said respective ends being secured to said respective end walls adjacent their rear edges;

a net having a width substantially equal to the lateral spacing between said end walls, said net having a top edge that is secured to said first connecting member, said net having a bottom edge that is secured to said second connecting member; and an elongated tether line having a predetermined length and a first end and a second end, said first and second ends being secured respectively to said end walls so a person can hold onto said tether line and walk around the perimeter of a swimming pool and drag said skimmer over the surface of the water.

2. A swimming pool skimmer as recited in claim 1 wherein said end walls have a generally triangular shape.

3. A swimming pool skimmer as recited in claim 1 further comprising a plurality of apertures in said third connecting member that allow it to fill with water causing it to sink beneath the surface of the water when the pool skimmer is placed in the water of a swimming pool.

4. A swimming pool skimmer as recited in claim 1 further comprising at least one laterally extending brush assembly secured to the outside surface of each of said respective end walls.

5. A swimming pool skimmer as recited in claim 1 further comprising a laterally extending tubular anchor post secured to the inside surface of each of said respective end walls.

6. A swimming pool skimmer as recited in claim 1 wherein said first and second connecting members are tubular and filled with air which causes them to float when the skimmer is placed into the water.

7. A swimming pool skimmer as recited in claim 1 wherein the height of said net is at least greater than two times the vertical spacing distance between said first and second connecting members so that it forms a concave shape when dragged through the water for collecting debris floating on the top surface of the water.

* * * * *